US007244134B2

(12) United States Patent
Ju

(10) Patent No.: US 7,244,134 B2
(45) Date of Patent: Jul. 17, 2007

(54) ELECTRICAL CONNECTOR HAVING A LOCKING DEVICE

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/266,267

(22) Filed: Nov. 4, 2005

(65) Prior Publication Data

US 2007/0105448 A1 May 10, 2007

(51) Int. Cl.
*H01R 13/62* (2006.01)

(52) U.S. Cl. ..... 439/327; 439/372

(58) Field of Classification Search ..... 439/327, 439/328, 372
See application file for complete search history.

(56) References Cited

U.S. PATENT DOCUMENTS 4,671,594 A * 6/1987 Ohtsuki et al. ..... 439/347
4,872,853 A * 10/1989 Webster ..... 439/327
5,417,580 A * 5/1995 Tsai ..... 439/328
5,924,886 A * 7/1999 Achammer et al. ..... 439/372

* cited by examiner

*Primary Examiner*—Thanh-Tam Le
(74) *Attorney, Agent, or Firm*—Troxell Law Office, PLLC

(57) ABSTRACT

The present invention discloses an electric connector for inserting an expansion card, and the electric connector includes an insulating body having a plurality of terminal containing holes, at least one electrically conductive terminal disposed in the terminal containing hole, and at least one locking device being disposed on at least one end of the insulating body and capable of rotating around the insulating body, and the locking device is a bent metal rod. Compared with the prior art, the electric connector of the present invention can be fixed securely to assure a good electric connection.

8 Claims, 4 Drawing Sheets

ELECTRICAL CONNECTOR HAVING A LOCKING DEVICE

BACKGROUND OF THE INVENTION

1. Field of the Invention

The present invention relates to an electric connector, and more particularly to an electric connector having a lock device.

2. Description of the Related Art

An expansion card is a common device of a circuit board, and an electronic component having a corresponding function can be produced on the circuit board by electrically connecting the corresponding circuits of a connector and a motherboard. In general, it requires a locking device to secure the connection of an expansion card with a connector. U.S. Pat. No. 5,494,451 discloses a structure of a retaining latch of a printed circuit board for securing a connector that is plugged into the printed circuit board. The aforementioned retaining latch comprises a connector fastening portion for engaging a connector and a board fastening portion for engaging the edge of the printed circuit board, and the connector fastening portion and the board fastening portion are connected by a resilient portion. Further, the board fastening portion includes a release tab connected to the board fastening portion for separating the printed circuit board from the board fastening portion. However, the foregoing structure requires repeated bending in the latching process, and thus causing a permanent deformation to the retaining latch easily. Furthermore, the holding force of such retaining latch is very small, and the retaining latch will be loosened easily, and thus causing a poor contact with the expansion card and affecting the normal electric connection. Therefore, it is necessary to design a novel electric connector to overcome the foregoing shortcomings.

SUMMARY OF THE INVENTION

In view of the description above, the inventor of the present invention based on years of experience of the design and sales of computer connector products to conduct extensive experiments and tests in hope of overcoming the foregoing shortcomings of the prior art electric connector such as a too small holding force of the retaining latch and the retaining latch being loosened easily which causes a poor contact with the expansion card and affects the normal electric connection.

The primary objective of the present invention is to provide an electric connector capable of securing its retaining status to assure a good electric connection.

To achieve the foregoing objective, the electric connector of the present invention for inserting an expansion card, comprising an insulating body having a plurality of terminal containing holes, at least one electrically conductive terminal disposed in the terminal containing hole, and at least one locking device disposed on at least one end portion and capable of rotating around the insulating body, and the locking device is a bent metal rod.

Compared with the prior art, the electric connector of the present invention can be fixed securely to assure a good electric connection.

To make it easier for our examiner to understand the objective of the invention, its structure, innovative features, and performance, we use a preferred embodiment together with the attached drawings for the detailed description of the invention.

DETAILED DESCRIPTION OF THE PREFERRED EMBODIMENTS

Figure 1:
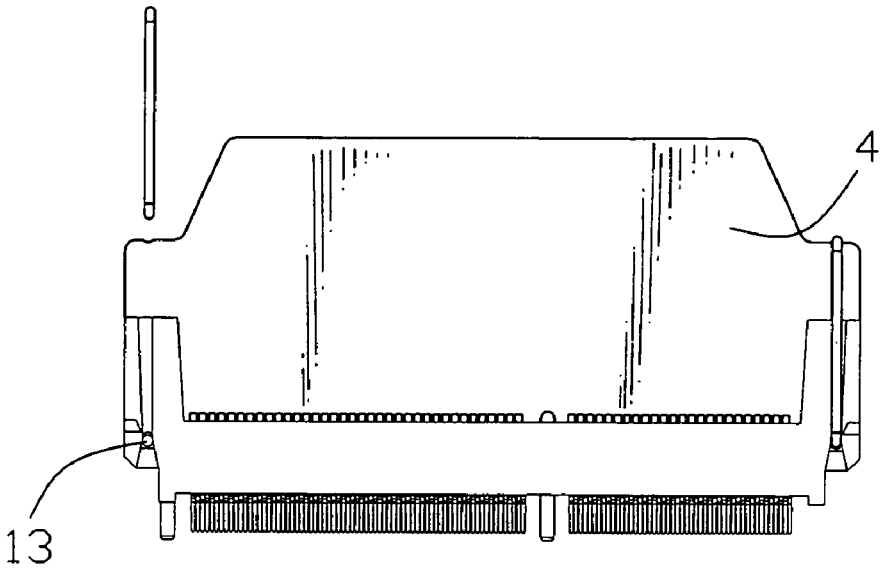
FIG. 1 is a planar view of an electric connector according to a preferred embodiment of the present invention.
Figure 2:
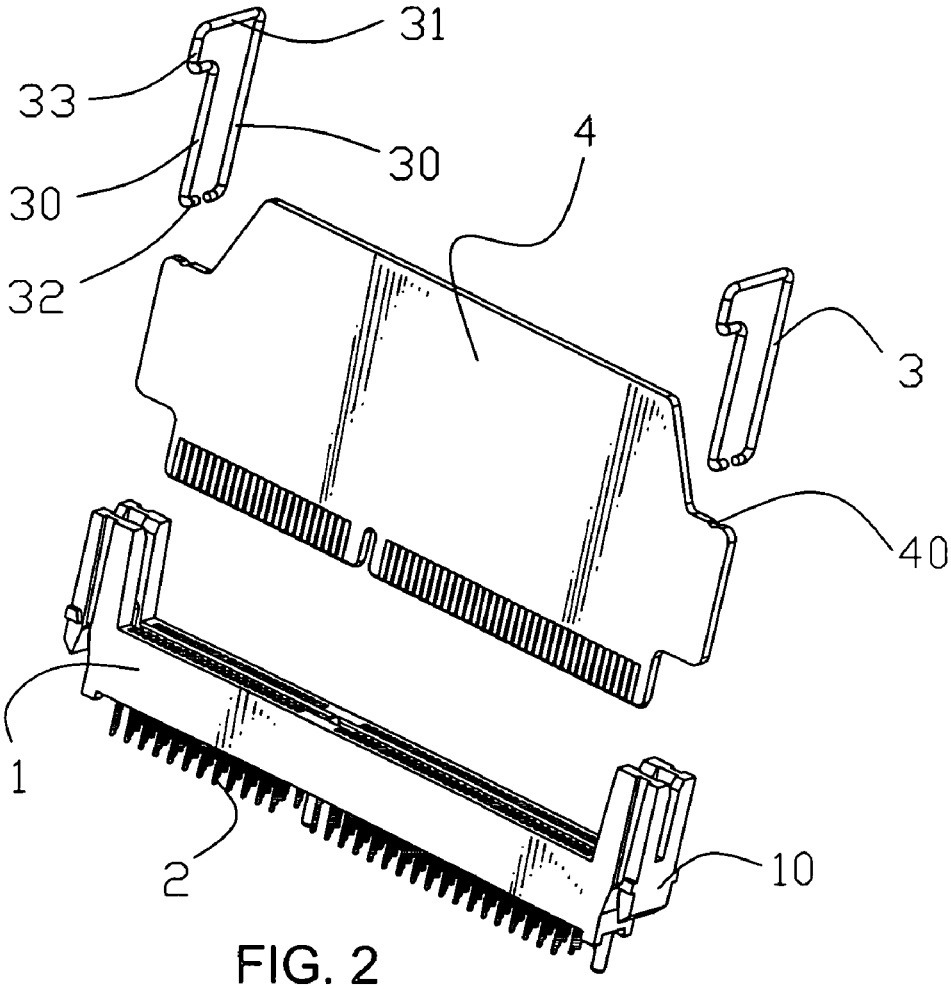
FIG. 2 is an exploded view of an electric connector and an expansion card according to a preferred embodiment of the present invention.
Figure 3:
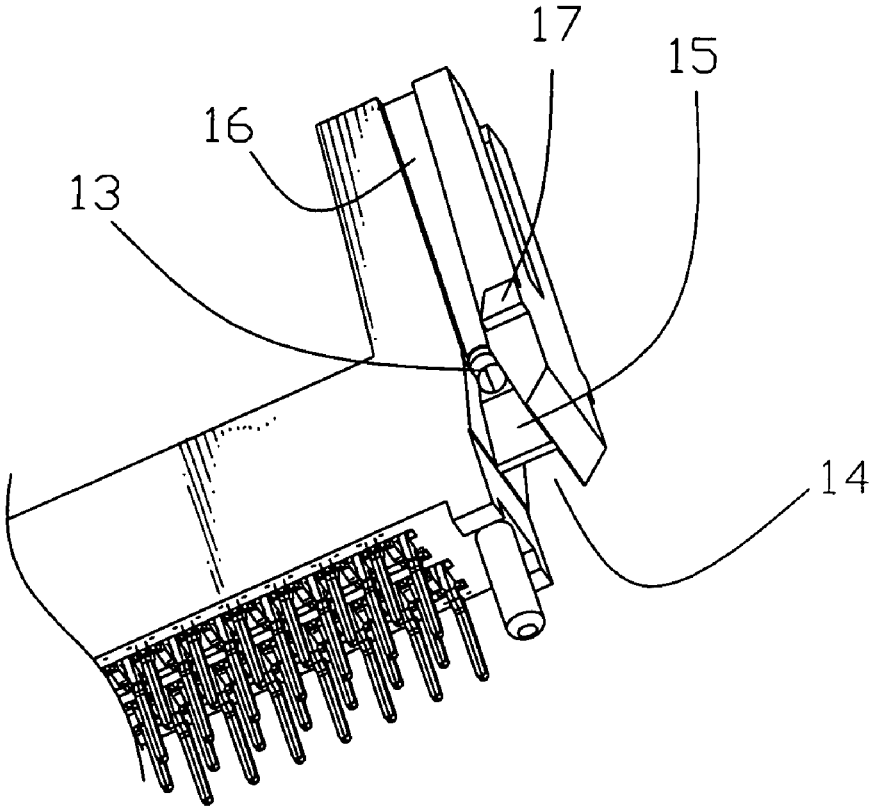
FIG. 3 is a schematic view of a portion of an electric connector according to a preferred embodiment of the present invention.
Figure 4:
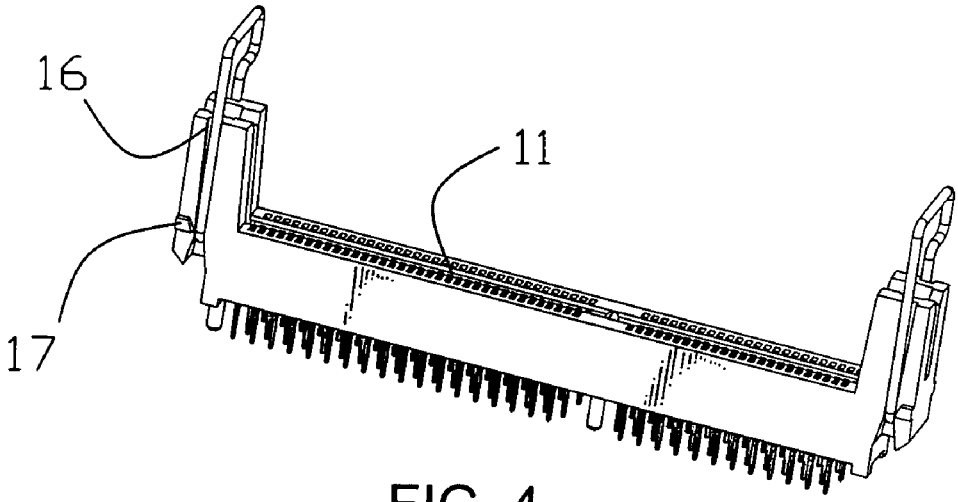
FIG. 4 is a perspective view of an electric connector according to a preferred embodiment of the present invention.
Figure 5:
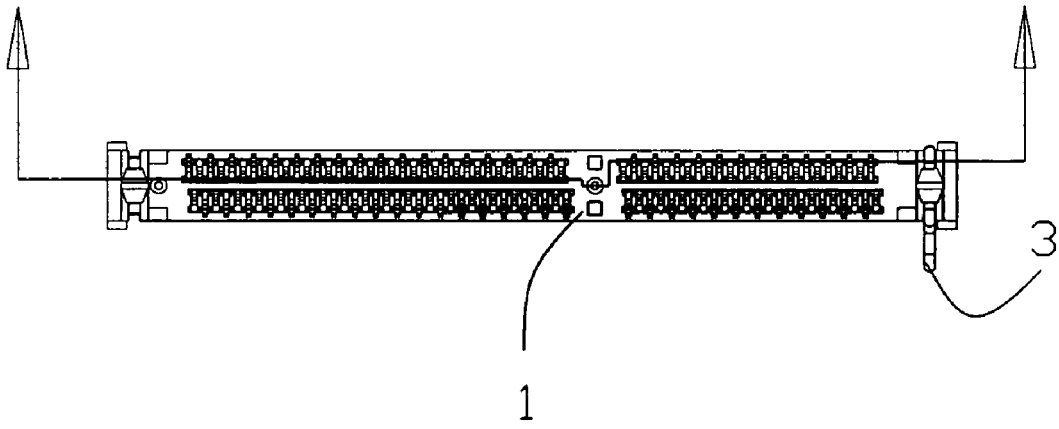
FIG. 5 is a top view of an electric connector according to a preferred embodiment of the present invention.
Figure 6:
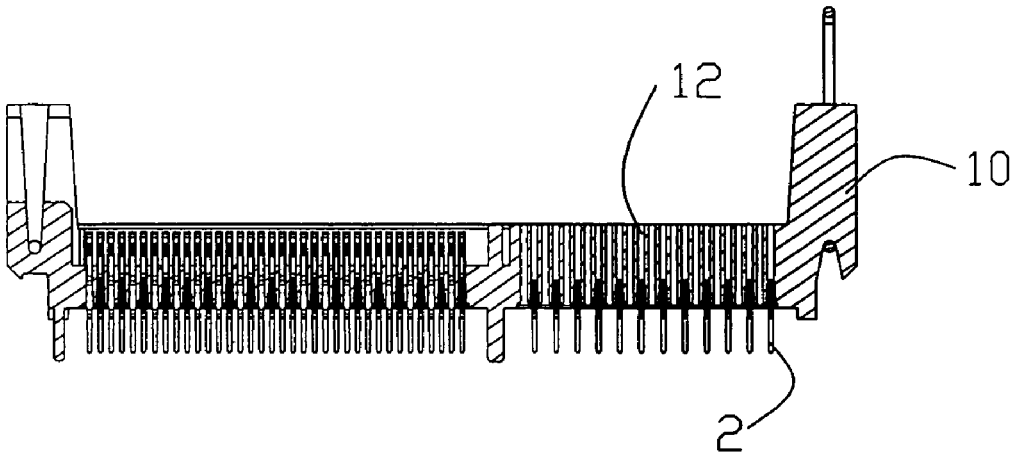
FIG. 6 is a cross-sectional view of the electric connector as depicted in FIG. 5.

The electric connector of the present invention will now be described in more detail hereinafter with reference to the accompanying drawings that show various embodiments of the invention.

Referring to FIGS. 1 to 6, the electric connector of the present invention used together with an expansion card 4 comprises an insulating body 1, a plurality of electrically conductive terminals 2 disposed in the insulating body 1, and a locking device 3 disposed at an end portion of the insulating body 1.

The insulating body 1 is substantially in the shape of a long bar having an insert slot 11 disposed at the middle section of the insulating body 1 for receiving the expansion card 4. Both sides of the insert slot 11 include a plurality of terminal containing holes 12 for receiving the terminals, and the insert slot 11 is interconnected with the terminal containing holes 12, so that each terminal 2 containing hole 12 contains an electrically conductive terminal 2.

The end portion 10 of the insulating body 1 includes an axle hole 13 for pivotally connecting the locking device 3 and a guide structure for guiding the locking device 3 into the axle hole 13. The guide structure includes a guide groove 14 tapered upward from the bottom of the end portion of the guide structure and a guide member 15; wherein the guide member 15 is substantially protruded in the shape of a wedge (of course, a guide groove 14 or a guide member 15 can be installed to achieve the guiding effect), and the guide groove 14 can guide the locking device 3 horizontally to an appropriate position, and the guide member 15 can guide the locking device 3 vertically upward to an appropriate position.

The end portion 10 of the insulating body 1 includes a fixing structure 16 (the fixing structure 16 of this preferred embodiment is a groove vertically penetrating the fixing structure 16, but not limited to such arrangement) for fixing the locking device 3 in a locked status. Further, the insulating body 1 includes a stopping member 17 disposed at an external side of the end portion 10 of the insulating body 1 for restricting an excessive outward rotation of the locking device 3. If the electric connector is installed to a circuit board (not shown in the figure), a gap (not shown in the figure) is formed between the lower end of the end portion 10 of the insulating body 1 and the circuit board for inserting the locking device 3 and facilitating the installation of the locking device 3.

The locking device 3 is a bent rod, including but not limited to a metal rod, and further includes a base portion 30, a latching portion 31 disposed at an end of the base portion 30, and a pivotal connecting section 32 disposed at another end of the base portion 30 and corresponding to the axle hole 13. The base portion 30 includes two vertical rods, and the pivotal connecting section 32 is formed by being extended horizontally inward from an end of the rod 30, and the latching portion 31 is connected to one of the rods 30 and horizontally disposed. Further, the locking device 3 comprises an operating portion 33, wherein an end of the operating portion 33 is connected to the latching portion 31, and another end is connected to another rod 30. By turning the operating portion 33, the locking device 3 can be switched between the locked status and the unlocked status.

When an expansion card 4 is installed, the locking device 3 is rotated such that the locking device 3 is switched to the unlocked status to insert the expansion card 4, and then the locking device 3 is switched to the locked status. Now, the latching portion 31 of the locking device 3 is corresponsive to a holding portion 40 of the expansion card 4, so that the expansion card 4 is secured onto the electric connector. If it is necessary to remove the expansion card 4, the locking device 3 is switched to the unlocked status, so that the locking device 3 can be removed. Further, the locking device 3 can be turned to a horizontal position to facilitate its packaging.

Figure 7:
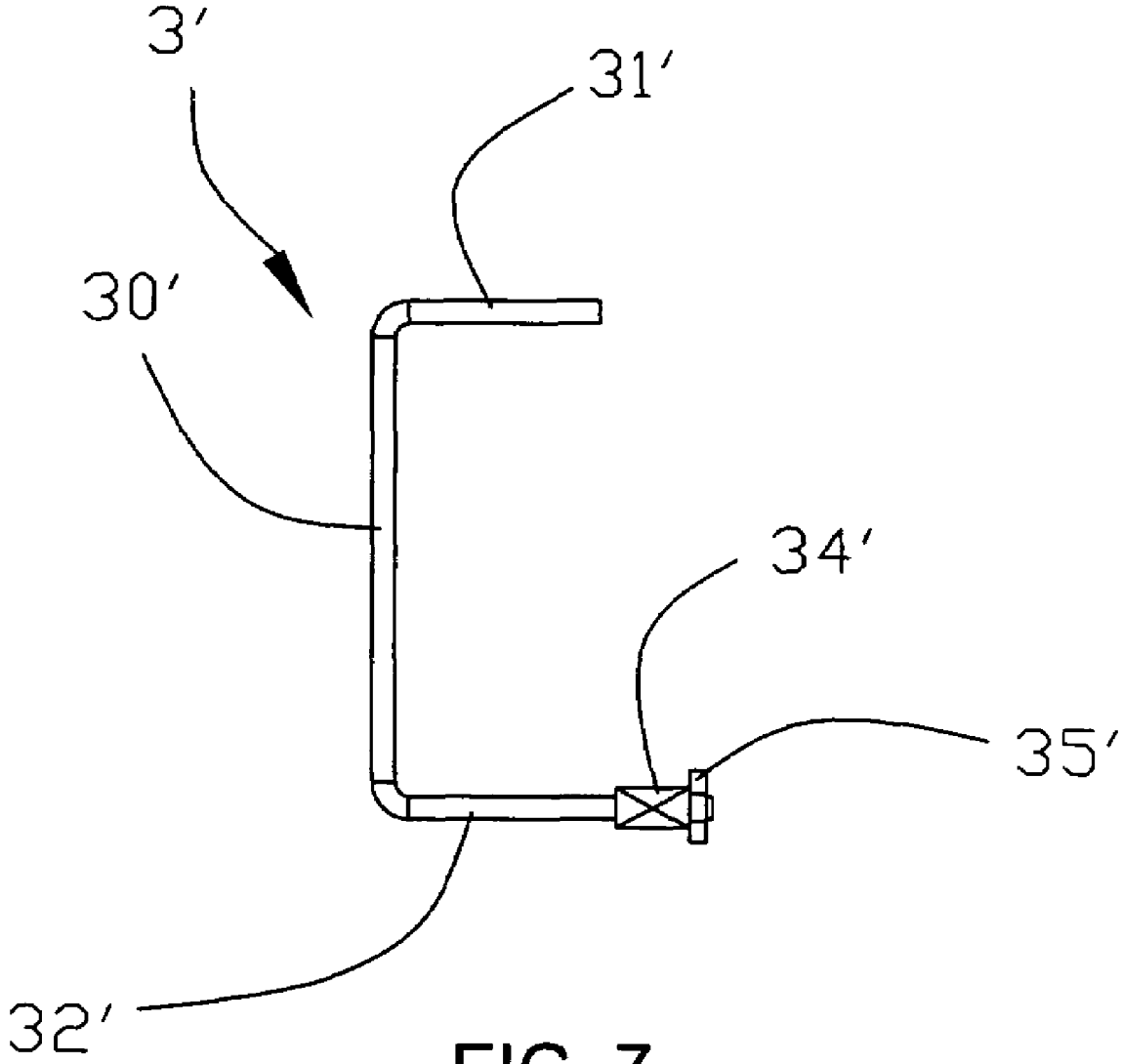
FIG. 7 is a schematic view of a locking device of an electric connector according to another preferred embodiment of the present invention.

Referring to FIG. 7 for the schematic view of a locking device 3' of an electric connector according to another preferred embodiment of the present invention, the shape of a locking device 3' according to another preferred embodiment could be a vertical rod disposed at the base portion 30', and a pivotal connecting portion 32' is formed by being extended horizontally from an end of the base portion 30' and a latching portion 31' is formed by being extended horizontally from another end of the base portion 30'. A resilient member 34' is installed at an end of the pivotal connecting portion 32'. If the locking device 3' is installed onto the insulating body 10, the locking device 3' is fixed by a fixing means 35'. Now, the base portion 30' and the resilient member 34' are situated separately on both sides of the insulating body 10.

When the expansion card 4 is installed, the locking device 3' is turned to the unlocked status to insert the expansion card 4, and then the locking device 3' is turned to the locked status. Now, the latching portion 31' of the locking device 3' is corresponsive to the holding portion 40 of the expansion card 4, such that the expansion card 4 is secured onto the electric connector. If it is necessary to remove the expansion card 4, the locking device 3' is turned to the unlocked status, and the expansion card 4 can be removed. Further, the locking device 3' can be turned horizontally inward to facilitate its packaging.

With the implementation of the present invention, a locking device can securely latch the expansion card onto the connector, and such secured connection assures a good electric connection between the expansion card and the connector, and thus can overcome the shortcomings of the prior art electric connector/

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

In summation of the above description, the present invention herein enhances the performance than the conventional structure and further complies with the patent application requirements and is submitted to the Patent and Trademark Office for review and granting of the commensurate patent rights.

What is claimed is:

1. An electric connector for inserting an expansion card, comprising:

an insulating body, having a plurality of terminal containing holes thereon;

at least one electrically conductive terminal, being received in said terminal containing holes; and at least one locking device, disposed on at least one end portion and capable of rotating around said insulating body, and said locking device is a bent rod, wherein said end portion of said insulating body further comprises an axle hole for pivotally connecting said locking device, wherein said locking device further comprises a base portion, a latching portion, and a pivotal connecting portion, wherein said latching portion is disposed at an end of said base portion, and said pivotal connecting portion is disposed at another end of said base portion for pivotally connecting said axle hole, wherein said base portion comprises two vertical rods, and said pivotal connecting portion is formed by being extended horizontally inward from an end of each of said vertical rod, and said latching portion is coupled with said one vertical rod and disposed horizontally, and said latching portion further comprises an operating portion and one end of said operating portion is coupled with said latching portion and another end is coupled to said other vertical rod, said one vertical rod being longer than said other vertical rod, said operating portion protruding outwards from said other vertical rod.

2. The electric connector of claim 1, wherein said insulating body further comprises a guide structure disposed at an end portion of said insulating body for guiding said locking device to an axle hole.

3. The electric connector of claim 2, wherein said guide structure comprises a guide groove being tapered upward to increasingly widen as the groove extends upwards from a bottom of said end portion to a top of said end portion.

4. The electric connector of claim 2, wherein said guide structure comprising a guide member, and said guide member is protruded substantially in the shape of a wedge having a downward facing pointed surface configured to be spaced from a circuit board when said electrical connector is installed on the circuit board.

5. The electric connector of claim 1, wherein said insulating body comprises a fixing structure disposed at an end portion of said insulating body for fixing said locking device into a locked status.

6. The electric connector of claim 5, wherein said fixing structure comprises a groove penetrating said fixing structure vertically.

7. The electric connector of claim 1, wherein said insulating body further comprises a stopping member disposed at an external side of an end of said insulating body for restricting an excessive outward rotation of said locking device.

8. The electric connector of claim 1, wherein said locking device is a bent metal rod.

* * * * *